US005738234A

United States Patent [19]

Harrold

[11] Patent Number: 5,738,234

[45] Date of Patent: Apr. 14, 1998

[54] CONTAINER INSERT FOR VOLUME REDUCTION AND TABLET STABILITY

[75] Inventor: John E. Harrold, Bloomsbury Borough, N.J.

[73] Assignee: Pakmax, Inc., Easton, Pa.

[21] Appl. No.: 679,176

[22] Filed: Jul. 12, 1996

[51] Int. Cl.[6] ..... B65D 23/00; A61J 1/03

[52] U.S. Cl. ..... 215/386; 206/204; 206/540; 428/24; 428/26

[58] Field of Search ..... 428/24, 26; 215/386; 206/204, 540

[56] References Cited

U.S. PATENT DOCUMENTS

| | | | |
|---|---|---|---|
| 2,275,293 | 3/1942 | Foley | 206/540 |
| 3,039,220 | 6/1962 | Fristot | 428/26 |
| 3,820,309 | 6/1974 | Cullen et al. . | |
| 3,918,578 | 11/1975 | Cullen et al. . | |
| 3,930,280 | 1/1976 | Vasas . | |
| 4,077,536 | 3/1978 | Brandtberg . | |
| 4,460,090 | 7/1984 | Paoletti | 206/540 |
| 4,811,856 | 3/1989 | Fischman . | |
| 5,318,183 | 6/1994 | Cohen et al. . | |

FOREIGN PATENT DOCUMENTS

| | | | |
|---|---|---|---|
| 851308 | 10/1960 | United Kingdom | 428/26 |

*Primary Examiner*—Stephen P. Garbe
*Attorney, Agent, or Firm*—Kenneth P. Glynn, Esq.

[57] ABSTRACT

The present invention is a container insert for volume reduction and tablet stability. It includes a flexible cup member and a rigid stem member. The flexible cup member is comprised of a plurality of correlate petal-like appendages and a hollow stem member. When the container insert is inserted into the mouth of a container, the flexible cup member appendages are flexed inwardly thereby permitting the insert to be fully inserted. When the insert is in place, it may either reside in the base of a container or, alternatively, in the neck of the same. When flexed, the petal-like appendages conform to the shape and dimension of the inside of the container. To accomplish such conformation, the appendages are capable of successive offset overlapping so as to form a bowl-like shape once inserted, much like the petals of a tulip. Preferably, the cup member includes a centrally located mound, and the stem member includes a desiccant retaining element and at least one venting cut-out.

22 Claims, 4 Drawing Sheets

CONTAINER INSERT FOR VOLUME REDUCTION AND TABLET STABILITY

BACKGROUND OF THE INVENTION

1. Field of the Invention

The present invention relates to container inserts, and more particularly to container inserts for volume reduction and tablet stability which have a flexible cup member and a rigid stem member.

2. Information Disclosure Statement

The following six patents represent several variations on container inserts which exemplify the art.

U.S. Pat. No. 3,820,309 to John S. Cullen and Paul W. Huber teaches an absorbent cartridge, containing an absorbent which may also be a desiccant, for insertion into a container comprising a permeable casing having a longitudinal axis and a cylindrical side wall and substantially planar opposed end walls extending substantially perpendicularly to the side wall, and absorbent material in said casing.

U.S. Pat. No. 3,918,578 to John S. Cullen and Paul W. Huber teaches a desiccant end cap for mounting on a hollow cylindrical member having an annular flange with a face portion and an outer annular portion extending transversely thereto comprising a cup-like member having an end portion and an annular rim extending substantially perpendicularly to the end portion for overlying the outer portion of the flange with an interference fit, desiccant container means mounted centrally on the end portion for positioning within the hollow tubular member, spacer dimples on the end portion in spaced relationship to the face portion of the flange, and latching dimples on the rim for engaging the flange with a holding fit.

U.S. Pat. No. 3,930,280 to Martin M. Vasas teaches a diaphragm structured within the bottle insert to provide either a cylindrical or non-cylindrical wipe over the particular type of applicator tip selected for use in the product container. Furthermore, provisions are incorporated within the bottle insert to block passage through the wiping diaphragm of misaligned comb type applicator tips and these provisions are made self-aligning for such tips with minor structural modification.

U.S. Pat. No. 4,077,536 to Kai Brandtberg teaches a plastic insert for sealing caps such as Crown Corks which is capable of forming a seal impermeable to liquid when it is pressed by the cap against the beaded mouth of a container. The insert comprises a central projection directed towards the interior of the container.

U.S. Pat. No. 4,811,856 to Harry H. Fischman teaches an audible sound protecting mechanism and tamper proof disc to prevent and deter persons from implanting contaminated substances into bottles containing capsules, tablets or caplets, removing the contents of the bottle, changing their composition, replacing the contents back into the bottle and restoring the bottle to its original condition so as to appear untouched for the purpose of doing harm to another person.

U.S. Pat. No. 5,318,183, to Donald B. Cohen and Norris W. Matthews teaches a bottle having an inserted tube in its neck to effectively reduce its interior volume and allow a large surface area for the bottle exterior, e.g. for supporting a large label or to allow oversized print, with a relatively small interior volume, e.g. to prevent abrasions caused by the interior contents moving excessively against each other.

Notwithstanding the prior art in this field, it is believed that the present invention, which comprises a flexible cup member and rigid stem member, as described herein, is neither taught nor rendered obvious.

SUMMARY OF THE INVENTION

The present invention is a container insert for volume reduction and tablet stability. It includes a flexible cup member and a rigid stem member. The flexible cup member is comprised of a plurality of corollate petal-like appendages and a hollow stem member. When the container insert is inserted into the mouth of a container, the flexible cup member appendages are flexed inwardly thereby permitting the insert to be fully inserted. When the insert is in place, it may either reside in the base of a container or, alternatively, in the neck of the same.

When flexed, the petal-like appendages conform to the shape and dimension of the inside of the container. To accomplish such conformation, the appendages are capable of successive offset overlapping so as to form a bowl-like shape once inserted, much like the petals of a tulip. Preferably, the cup member includes a centrally located mound, and the stem member includes a desiccant retaining element and at least one venting cut-out which works concurrently with a desiccant. The preferred embodiment of the present invention is unistructurally molded and is capable of conforming to any shaped container, i.e., square, circular and/or otherwise.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The present invention is a container insert for volume reduction and tablet stability. It includes a flexible cup member and a rigid stem member. The flexible cup member is comprised of a plurality of corollate petal-like appendages and a hollow stem member. When the container insert is inserted into the mouth of a container, the flexible cup member appendages are flexed inwardly thereby permitting the insert to be fully inserted. When the insert is in place, it may either reside in the base of a container or, alternatively, in the neck of the same.

When flexed, the petal-like appendages conform to the shape and dimension of the inside of the container. To accomplish such conformation, the appendages are capable of successive offset overlapping so as to form a bowl-like shape once inserted, much like the petals of a tulip. However, once inserted into a container, the insert is adapted to hold pills and the like in the area above the flexed petal-like members by virtue of its overlapping pattern which is constructed to hold pills thereupon. Preferably, the cup member includes a centrally located mound, and the stem member includes a desiccant retaining element and at least one venting cut-out which works concurrently with a desiccant. The preferred embodiment of the present invention is unistructurally molded and is capable of conforming to any shaped container, i.e., square, circular and/or otherwise.

The present invention may be constructed from molded plastic and or any other suitable material commonly used in the art. The present invention may comprise any variety of sizes and shapes, particularly the flexible cup member. The present invention may be used as a volume reducer and a tablet stabilizer and may be positioned at any variety of locations within a container.

Figure 1:
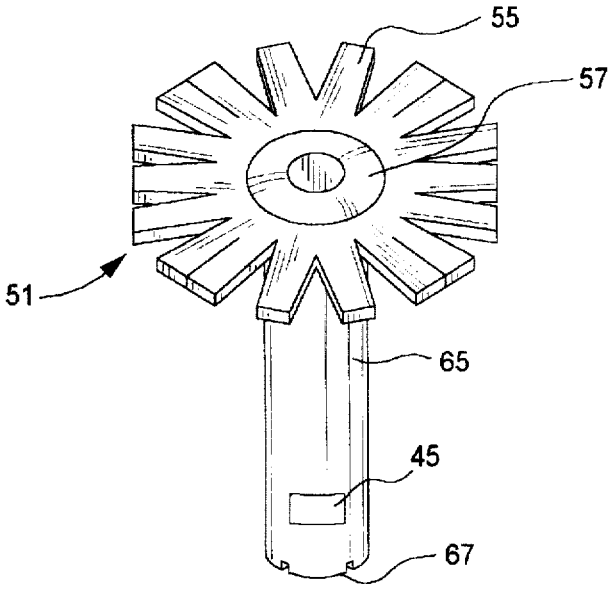
FIG. 1 shows a partial top, partial side view of a present invention container insert.
Figure 2:
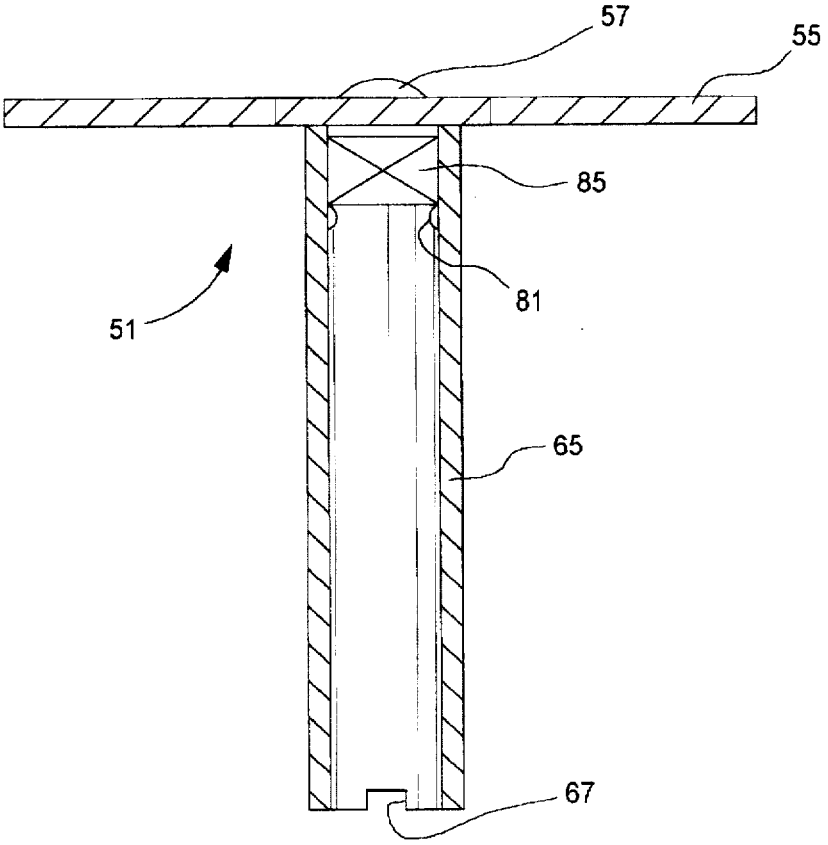
FIG. 2 shows a cut side view of a present invention container insert.

FIG. 1 shows a partial top, partial side view of a present invention container insert. FIG. 2 shows a cut side view of a present invention container insert, as shown in FIG. 1. Referring to FIGS. 1 and 2, container insert 51 has flexible cup member 55 and hollow stem member 65 which is attached to cup member 55. Stem member 65 includes volume reduction indicia 45 which indicates the volume reducing capability of the container insert 51. It should be clear that indicia 45, as shown, is merely illustrative. Preferably, container insert 51 is unistructurally molded, so as to enhance the integrity of insert 51. As shown, mound 57 is centrally located upon the upper side of cup member 55. Mound 57 serves to improve the functionality of cup member 55 when tablets are being held in place. Stem member 65 is shown comprising venting cut outs 67 and desiccant holding means 81, which retain desiccant 85 in place. Thus, stem member 65 is multi-functional as both a support component and as a desiccator. While desiccant holding means 81 is shown as being a plurality of small protrusions, it is to be understood that any form may be employed, i.e. an annular ring. It is also to be understood that venting cut outs 67 may be located at any place on stem member 65 without exceeding the scope of the present invention.

Figure 4:
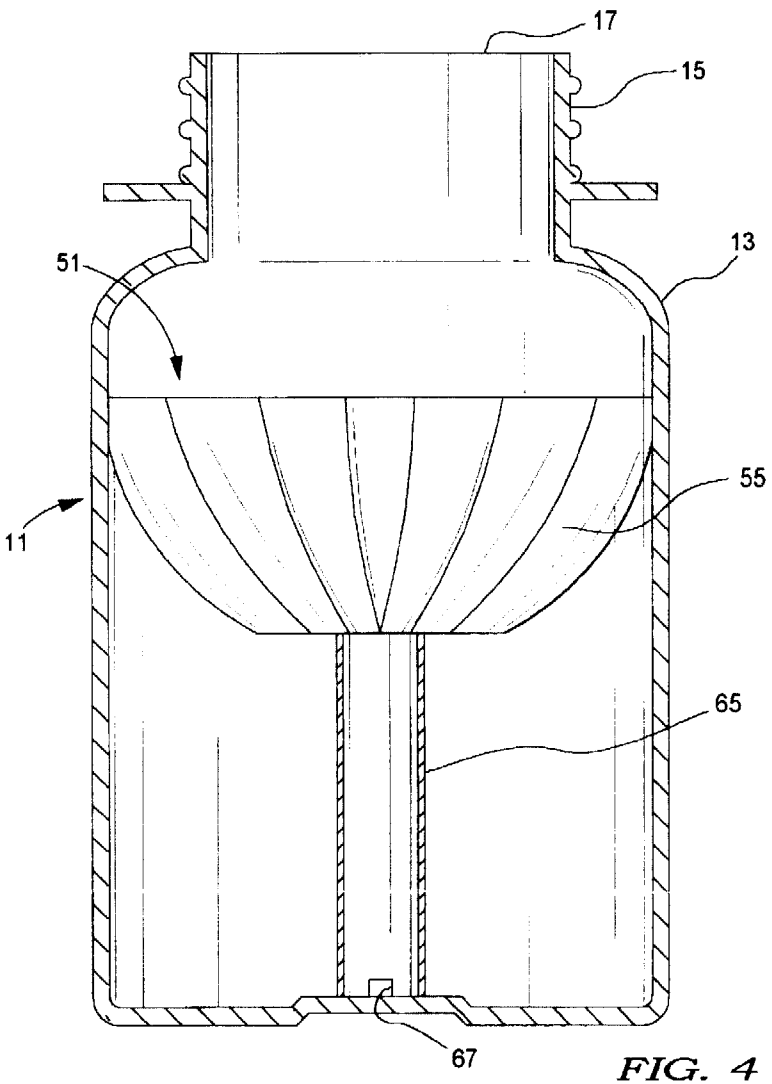
FIG. 4 shows a cut side view of a present invention container insert, illustrating details of the container insert in a flexed position while retained in the base of a container.
Figure 3:
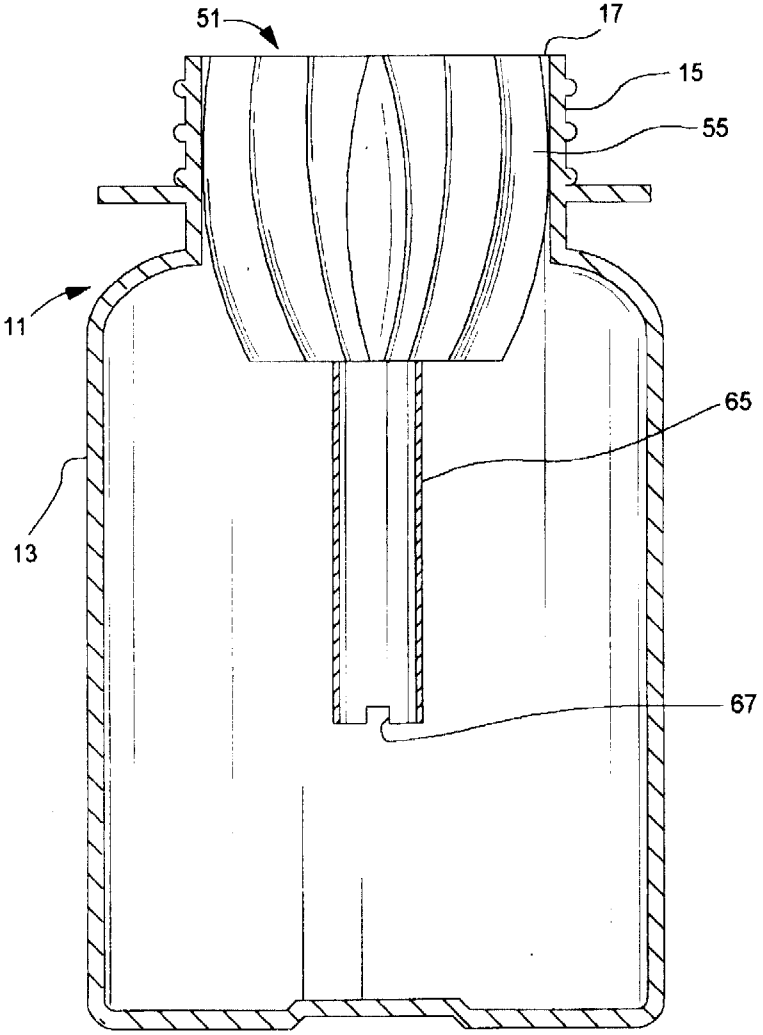
FIG. 3 shows a cut side view of a present invention container insert, illustrating details of the container insert in a flexed position while retained in the neck of a container.
Figure 5:
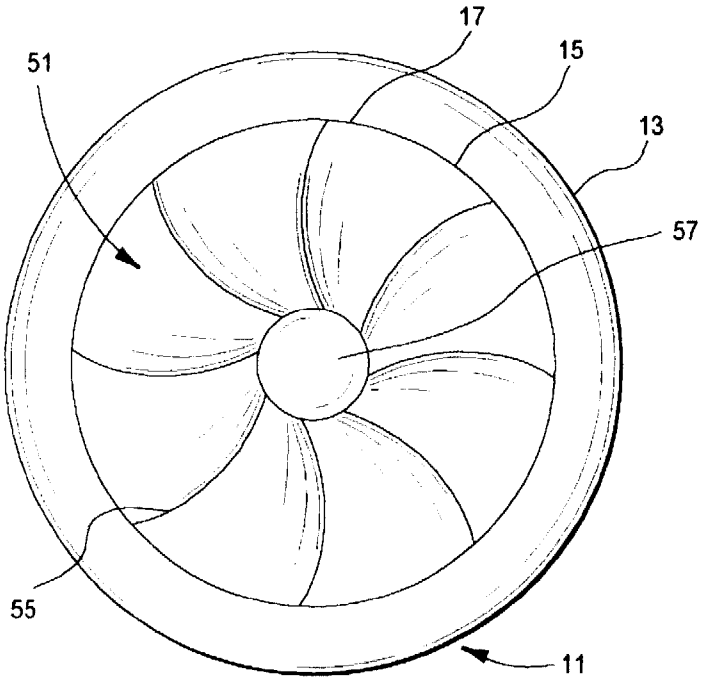
FIG. 5 shows a top view of a present invention container insert as shown in FIG. 4.

FIG. 3 shows a cut side view of a present invention container insert, illustrating details of the container insert in a flexed position while retained in the neck of a container. FIG. 4 shows a cut side view of a present invention container insert, illustrating details of the container insert in a flexed position while retained in the base of a container. FIG. 5 shows a top view of a present invention container insert as shown in FIG. 4.

Referring to FIGS. 3,4 and 5, container insert 51 is shown flexed and in assorted positions within container 11. Flexible cup member 55 is shown conforming to the inner shape of neck 15 and also conforming to the inner shape of base 13. Thus, when container insert 51 is inserted into open mouth 17, cup member 55 flexes inwardly and upwardly conforming to the exact dimensions of container 11. Once in place, container insert 51 reduces the initial inner volume of container 11 to a pre-selected alternate volume. The alternate volume will be dependent upon the length of stem 65 and the dimensions of cup member 55. It is also to be understood that a stem member may be solid throughout without exceeding the scope of the present invention.

Figure 6:
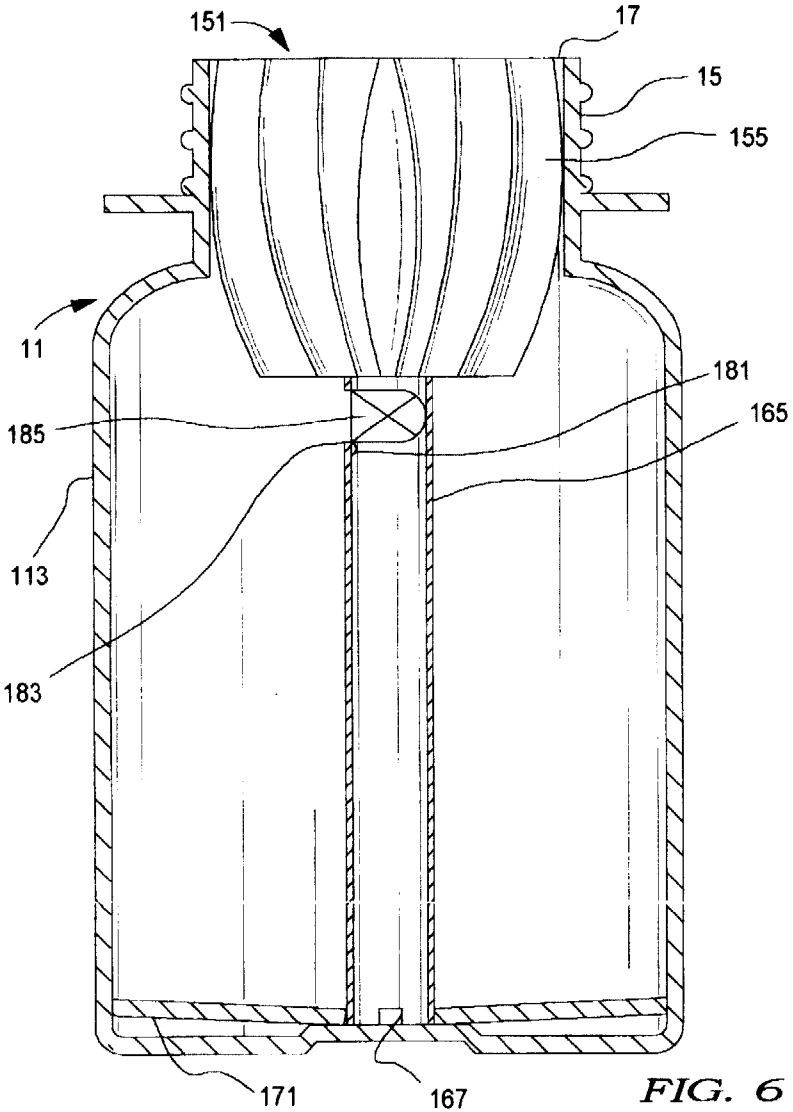
FIG. 6 shows a cut side view of an alternative embodiment present invention container insert, illustrating details of the container insert in a flexed position while retained in the neck of a container.

Referring to FIG. 6, alternative embodiment container insert 151 is shown flexed within container 11. Flexible cup member 155 is shown conforming to the inner shape of neck 15. Thus, when container insert 151 is inserted into open mouth 17, cup member 155 flexes inwardly and upwardly conforming to the exact dimensions of container 11. Once in place, container insert 151 reduces the initial inner volume of container 11 to a pre-selected alternate volume. Here, stem 165 is long enough to greatly reduce the inner volume of container 11. Stem 165 is fitted with cut out 183 so that desiccant 185 may be inserted into stem 165. Desiccant 185 is held in place by desiccant holding means 183, here a protruding bead. Stem 165 has venting cut outs 167 which may be employed concurrently with cut out 183 to enhance the influence of desiccant 185. In addition, stem member 165 is fitted with anti-sway stabilizing member 171 which is shown as an annular extension. Anti-sway stabilizing member 171 prevents stem member 165 from shifting back and forth while in use, thus improving the volume reducing capabilities. While stabilizing member is shown here as an annular extension, it is to be understood that it may be any type of extension, i.e. a plurality of posts, without exceeding the scope of the present invention. It is also to be understood that it is not required that stabilizing member 171 be located at the bottom of stem member 165. Thus the location of stabilizing member 171 in FIG. 6 is purely illustrative.

Figure 7:
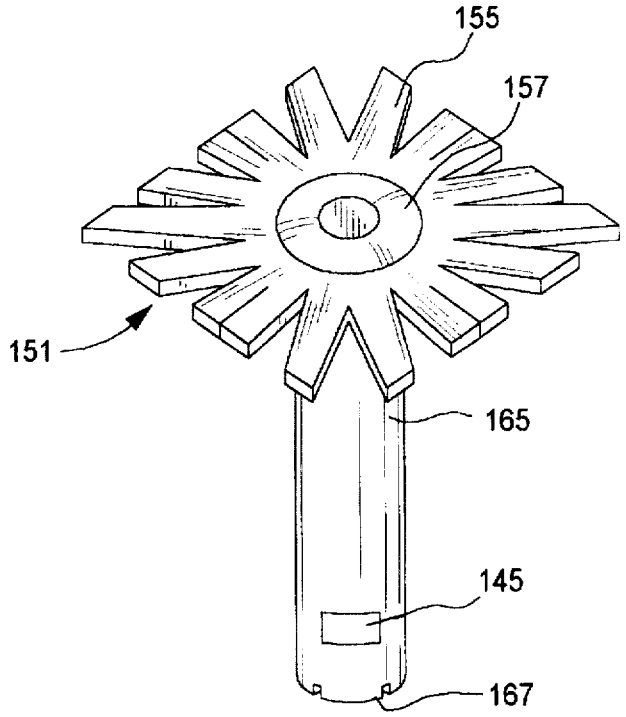
FIG. 7 shows a partial top, partial side view of an alternative embodiment of a present invention container insert having a square shape; and, FIG. 8 shows a partial top, partial side view of an alternative embodiment of a present invention container insert having a triangular shape.
Figure 8:
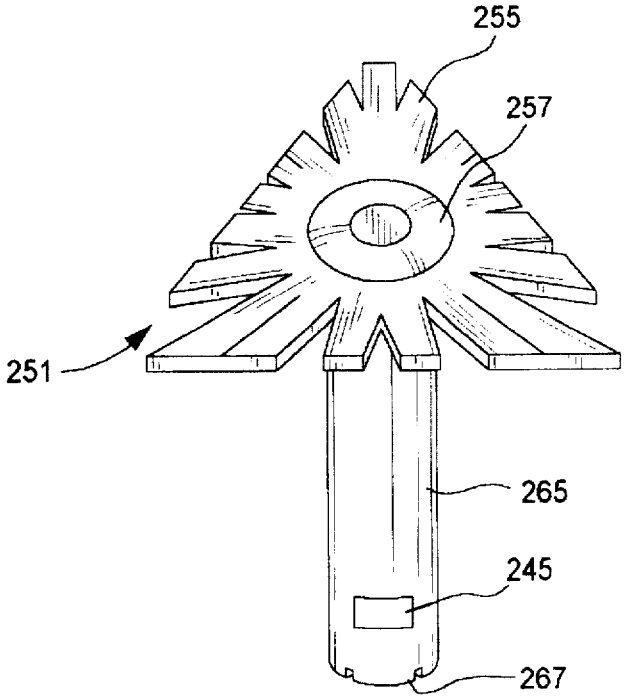

Referring now to FIGS. 7 and 8, there is shown a square-shaped and a triangular-shaped container insert, respectively. Like parts are similarly numbered to those in FIG. 1 but beginning with '100' and '200' for FIGS. 7 and 8, respectively. It should be understood that the container inserts shown in FIGS. 7 and 8 are capable of insertion into containers having corresponding shapes to the inserts.

Any number of pills or tablets may be precisely matched with a pre-selected alternate volume embodiment of the present invention so as to assure proper tablet stability in every circumstance. In other words, each alternative embodiment of the present invention may contain indicia indicating the precise size and the volume reducing capability. The present invention may even be capable of remaining within the neck of a container due to frictional engagement of the inner side of a container by flexed portions of the petal-like appendages, thus reducing inner volume greatly.

Obviously, numerous modifications and variations of the present invention are possible in light of the above teachings. It is therefore understood that within the scope of the appended claims, the invention may be practiced otherwise than as specifically described herein.

What is claimed is:

1. A container insert for a container comprising:

(a) a container having a base, a neck and an open mouth, said container having an outer side and an inner side; and (b) a container insert being confined within said container, said container insert comprising a flexible cup member and a rigid hollow stem member, said cup member being defined by a plurality of corollate petal-like members, said cup member having an upper side and a lower side opposite said upper side, said hollow rigid stem member having a first end and a second end, said stem member being connected to said flexible cup member at said first end, said stem member having an outer sidewall surface and an inner sidewall surface.

2. The container insert of claim 1 wherein said cup member is capable of insertion into said mouth of said container and conforming to said inner side of said container neck so as to retain said container insert in a suspended position within said container neck.

3. The container insert of claim 1 wherein said cup member and said stem member are unistructurally molded.

4. The container insert of claim 1 wherein said container insert comprises a mound member, said mound member being centrally located upon said upper side of said cup member.

5. The container insert of claim 1 wherein said stem member has means to receive a desiccant member therein and said stem member inner sidewall surface has means for retaining a desiccant member thereon.

6. The container insert of claim 1 wherein said stem member second end has at least one venting cut-out therein.

7. The container insert of claim 1 wherein said petal-like members are capable of successive offset overlapping so as to conform to the dimensions of said inner side of said container base and to form a bowl-like configuration.

8. The container insert of claim 1 wherein at least one of said cup member and said stem member comprises indicia which indicates the volume reducing capability of said container insert.

9. The container insert of claim 1 wherein said stem member is solid.

10. The container insert of claim 1 wherein said stem member second end has an anti-sway stabilizing member thereon.

11. A container insert comprising:

(a) a flexible cup member, said cup member being defined by a plurality of corollate petal-like members, said cup member having an upper side and a lower side opposite said upper side;

(b) a hollow rigid stem member having a first end and a second end, said stem member being connected to said flexible cup member at said first end, said stem member having an outer sidewall surface and an inner sidewall surface; and (c) an anti-sway stabilizing member, said stabilizing member being attached to said second end of said stem member.

12. The container insert of claim 11 wherein said flexible cup member has a circular shape.

13. The container insert of claim 11 wherein said flexible cup member has a square-like shape.

14. The container insert of claim 11 wherein said flexible cup member has a triangular shape.

15. The container insert of claim 11 wherein said flexible cup member and said stem member are unistructurally molded.

16. The container insert of claim 11 wherein said container insert comprises a mound member, said mound member being centrally located upon said upper side of said cup member.

17. The container insert of claim 11 wherein said stem member has means for receiving a desiccant member therein and said stem member inner sidewall surface has means for retaining a desiccant member thereon.

18. The container insert of claim 11 wherein said stem member second end has at least one venting cut-out therein.

19. The container insert of claim 11 wherein said petal-like members are capable of successive offset overlapping so as to conform to the dimensions of an inner side of a container base and to form a bowl-like configuration.

20. The container insert of claim 11 wherein at least one of said cup member and said stem member comprises indicia which indicate the volume reducing capability of said container insert.

21. A container insert comprising:

(a) a flexible cup member, said flexible cup member being defined by a plurality of corollate petal-like members, said cup member having an upper, side and a lower side opposite said upper side; and (b) a hollow rigid stem member having a first end and a second end, said stem member being connected to said flexible cup member at said first end, said stem member having an outer sidewall surface and an inner sidewall surface, said stem member also having means for receiving a desiccant member therein, said stem member inner sidewall surface having means for retaining a desiccant member thereon.

22. The container insert of claim 21 wherein said stem member second end has at least one venting cut-out therein and has an anti-sway stabilizing member thereon.

* * * * *